United States Patent [19]

Debard

[11] 4,132,333

[45] Jan. 2, 1979

[54] DISPENSING UNIT FOR AN AEROSOL CONTAINER

[75] Inventor: André Debard, Buc, France

[73] Assignee: Aerosol Inventions and Development S.A. AID SA, Fribourg, Switzerland

[21] Appl. No.: 746,687

[22] Filed: Dec. 2, 1976

[30] Foreign Application Priority Data

Dec. 3, 1975 [FR] France ..... 75 36937
Sep. 9, 1976 [FR] France ..... 76 27084

[51] Int. Cl.[2] ..... B65D 83/14
[52] U.S. Cl. ..... 222/402.13
[58] Field of Search ..... 222/402.13, 182

[56] References Cited

U.S. PATENT DOCUMENTS

| | | | |
|---|---|---|---|
| 3,058,626 | 10/1962 | Hibbs et al. | 222/182 |
| 3,107,033 | 10/1963 | Sanborn | 222/402.13 X |
| 3,578,220 | 5/1971 | Green et al. | 222/402.13 |
| 3,589,570 | 6/1971 | Gach | 222/402.13 |
| 3,674,184 | 7/1972 | Ewald | 222/402.13 |

*Primary Examiner*—Robert B. Reeve
*Assistant Examiner*—Francis J. Bartuska
*Attorney, Agent, or Firm*—Holman & Stern

[57] ABSTRACT

In a method for the relative orientation of the spray-discharge valve actuator and actuator nozzle of a container with respect to a protective cover which is designed to operate the valve actuator, the cover is brought closer to the actuator in coaxial relation thereto, the cover and actuator are brought into the desired relative orientation with friction between a radial lug carried by the actuator and a helical ramp carried by the cover and inclined at an angle of slope of at least 45° with respect to the axis. The cover is then brought in a movement of axial displacement to a position of operation of the actuator on the container.

7 Claims, 13 Drawing Figures

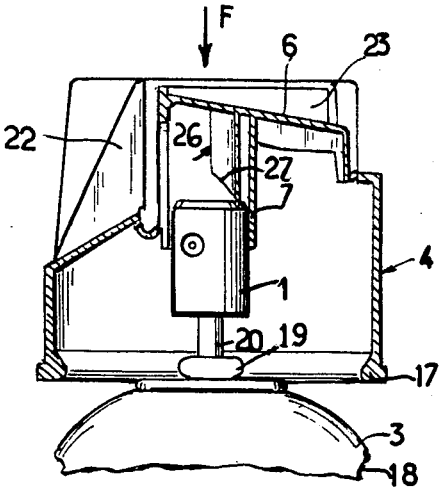
FIG. 6
FIG. 7
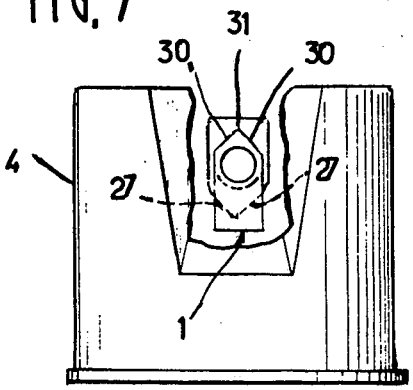
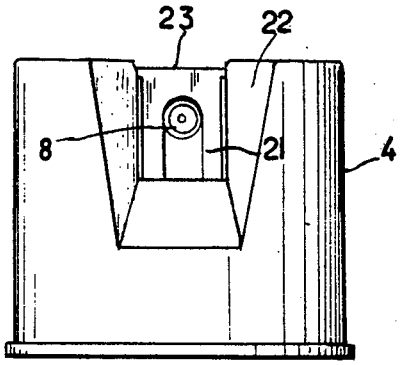
FIG. 9
FIG. 8
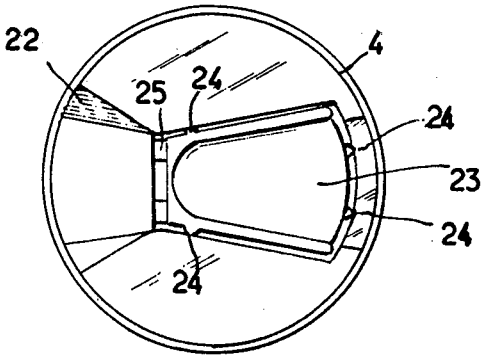

DISPENSING UNIT FOR AN AEROSOL CONTAINER

This invention relates to the packaging industry and especially to containers which serve to dispense products in spray form and which may be either of the "aerosol" type or of the "pump" type.

Dispensers of these types are usually fitted with an actuator which is intended to be operated by the user in order to cause the contents to be released through the valve or pump of the dispenser and through a spray-discharge nozzle carried by the actuator.

In order to prevent any accidental operation of the actuator, especially at the time of transportation of the container, the actuator is usually protected by a cover which is secured to the rim of the aerosol valve or of the container itself. Said protective cover is provided on the one hand with a spray-discharge recess or opening which is intended to be located opposite to the actuator nozzle and on the other hand with an opening which allows access to the actuator or with a lever for operating this latter.

When the protective cover is fixed in position over a "fitted actuator", that is, after the actuator has been secured to the valve or pump with which the container is equipped, it proves necessary to orient the cover with respect to the actuator in order to ensure that the spray-discharge opening of the cover is brought into position opposite to the spray-discharge nozzle of the actuator.

With this objective, two techniques are open to selection:

manual assembly, which is suitable for all types of actuators and protective covers but which entails high capital cost by reason of low production rates;

automatic assembly, which does permit high production rates but makes it necessary to design the actuator so as to have a top wall which is very steeply inclined since this latter constitutes a reference bearing surface for the orientation of the protective cover. It is readily apparent that this essential requirement limits the range of attractive shapes which can be given to the actuator and to the corresponding protective cover.

One drawback of the so-called "fitted actuator" mode of assembly lies in the need to uncouple the machines which are usually employed for mounting spray-discharge valve actuators and protective covers since it is necessary after placing the cover over the actuator to release said cover and to allow the necessary time for pivotal displacement of this latter in order to locate it in the desired position with respect to the actuator, with the result that an appreciable amount of time is wasted.

Furthermore, when it is required to carry out the filling of aerosol containers having male valves in the "fitted actuator" mode, losses of the order of 0.60 to 3.50 kg of propellant gas per thousand filling operations are observed. This not only represents a substantial and costly loss of gas but is also liable to modify the ecological equilibrium, at least at the filling location. On the contrary, if filling is performed without the actuator in accordance with customary practice in the case of female valves, gas losses are only of the order of 0.07 kg of propellent per thousand filling operations. This filling method can in fact be adopted, however, only if protective covers and actuators for female valves are available and can be mounted automatically.

The chief aim of the present invention is to overcome the above-mentioned disadvantages of known pressure packs and of the methods adopted for mounting these latter.

The invention is primarily concerned with a method for the relative orientation of the spray-discharge valve actuator and actuator nozzle of a container with respect to a protective cover which is designed to operate said valve actuator. The method is distinguished by the fact that the protective cover is brought closer to the spray-discharge actuator in coaxial relation thereto, that the cover and actuator are brought into the desired relative orientation with friction between a radial lug carried by the actuator and a helical ramp carried by the cover and inclined at an angle of slope of at least 45° with respect to the axis aforesaid, and that the cover is then brought in a movement of axial displacement to a position of operation of the spray-discharge valve actuator on the dispenser container.

The practical application of said method is particularly advantageous since it permits of automatic machine-operated assembly of the protective covers.

The invention is also concerned with a dispensing unit for an aerosol container comprising an actuator adapted to be connected to the container valve and provided with a lateral spray-discharge nozzle, and a protective cover provided with means for attaching to and retaining on the container and with a lateral spray-discharge opening. The dispensing unit is distinguished by the fact that the actuator is provided with a lug adapted to cooperate with a helical ramp carried by the protective cover, the respective profiles of the lug and of the ramp being such as to cause orientation of the protective cover and of the actuator with respect to each other and to bring the spray-discharge opening of the cover opposite to the actuator nozzle when said lug and ramp are in cooperating relation and when said cover moves towards the actuator in the axial direction.

The invention also extends to a method such as the preceding in which, after bringing the helical ramp of the protective cover into contact with the actuator lug, a positive and simultaneous control operation is performed so as to cause the angular displacement of the actuator to the desired position of the nozzle with respect to the cover and the fastening of said cover on said container by means of a single axial movement of the cover towards the container.

Thus the helical ramp of the cover causes the angular displacement of the actuator to the position which said actuator is finally intended to occupy in conjunction with the fastening of the cover on the container.

This operation can be carried out while the actuator is in position on the valve or can be combined with the positioning of the actuator on the valve. The invention is further directed to a dispensing unit for an aerosol container which comprises in the same manner as the preceding an actuator which is adapted to be connected to the container valve and provided with a lateral spray-discharge nozzle, and a protective cover provided with means for attaching to and retaining on the container and with a lateral spray-discharge opening oriented in the axis of said nozzle, said cover being provided with a wall which is coaxial internally with the sleeve; said wall is of semicircular cross-section and has a free edge cut in the form of a symmetrically helical double ramp having an angle of slope at least equal to 45°. The actuator is provided with a semi-annular recess which is coaxial with its principal axis and freely receives said semi-circular wall of the cover when said cover and the actuator are oriented, the actuator being provided at the top with a wedge-shaped lug which is located in the line of extension of the semi-annular recess and the arris of which is radially perpendicular to the principal axis of the actuator.

A more complete understanding of the invention will be gained from the following detailed description and from a study of the accompanying drawings in which three embodiments of the invention are shown by way of example without any limitation being implied, and in which:

FIG. 6 shows the positioning of the protective cover of FIG. 4 on a valve actuator;

FIG. 7 is a diagram showing the arrangement of the helical ramps of the sleeve and of the actuator lug in a front view of the unit shown in FIG. 4;

FIG. 8 is a top view of the protective cover;

FIG. 9 is a front view of the unit consisting of the oriented protective cover and actuator;

Figure 1:
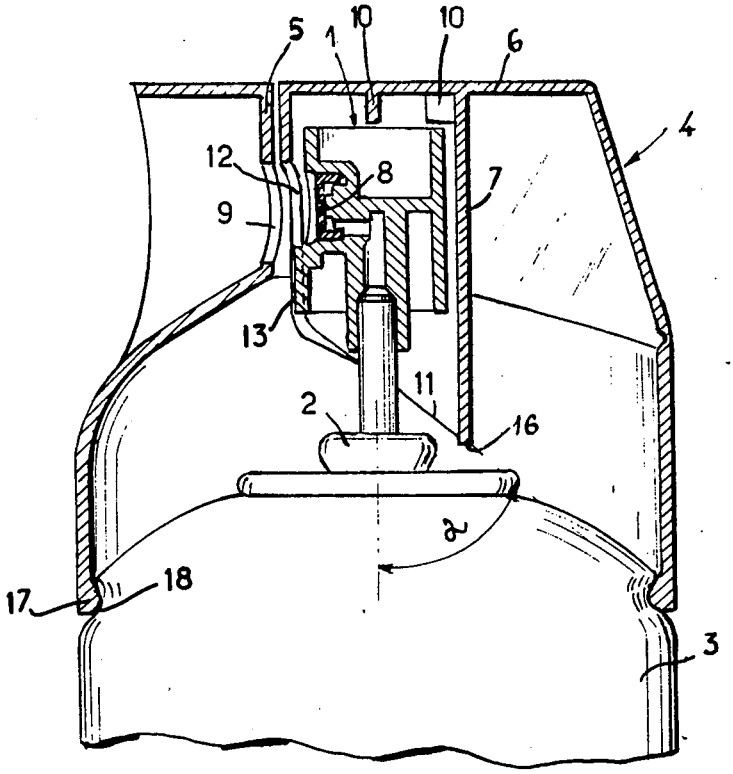
FIG. 1 is a fragmentary front sectional view of a first embodiment of the dispensing unit in accordance with the invention, said unit being mounted on an aerosol container.
Figure 2:
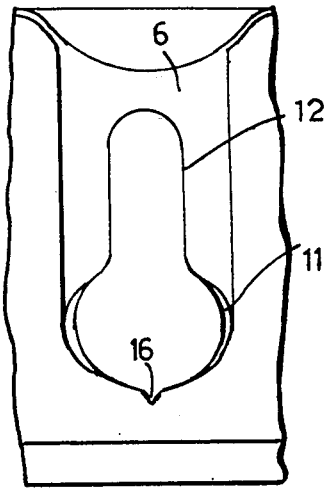
FIG. 2 is a fragmentary left-hand view of the protective cover shown in FIG. 1.
Figure 3:
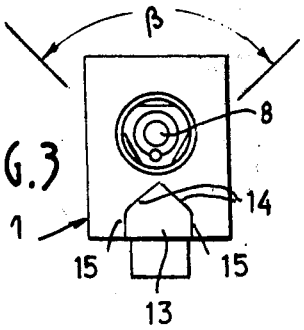
FIG. 3 is a left-hand view of the valve actuator shown in FIG. 1.

The dispensing unit in accordance with the invention as shown in FIGS. 1 to 3 essentially comprises an actuator 1 which is attached to the valve represented in the figure by the valve ferrule 2, an aerosol container 3, a protective cover 4 which is attached to the container 3 and retained on this latter.

The protective cover 4 comprises a stationary portion or body 5 and a movable portion 6 which is articulated on the body and can be actuated by hand. Said movable portion comprises a cylindrical sleeve 7 which is coaxial with the longitudinal axis of the protective cover. The stationary portion of the body 5 is pierced with a spray-discharge opening 9 located opposite to the nozzle 8 of the actuator 1. The top portion of the sleeve 7 is provided with top bearing members 10 which constitute the means for displacing the actuator 1 within the sleeve 7.

The sleeve 7 has a ramp 11-12, a symmetrically helical portion 11 of said ramp being constituted by the bottom edge of the sleeve. Said portion 11 of the ramp 11-12 is oblique with respect to the axial plane of symmetry of the protective cover and inclined at an angle $\alpha$ of approximately 60° with respect to the longitudinal axis of the cover.

The aforesaid portion 11 of the ramp 11-12 is extended in the upward direction without any break in continuity by means of a portion 12 which forms an elongated slot and the edges of which extend parallel to the longitudinal axis of the protective cover.

In order to cooperate with said ramp 11-12, the valve actuator 1 is provided with a lug 13 which projects from the remainder of the actuator and is provided with a point having bevelled faces 14 which make an angle $\beta$ of approximately 90° between them and are followed by two parallel sides 15.

In order to mount the protective cover 4 on the container which has previously been fitted with the valve actuator 1, it is only necessary to ensure that the cover 4 is aligned coaxially with the actuator 1 and to let said cover fall freely towards said actuator.

When the ramp 11-12 comes into contact with the lug 13 on either of the two bevelled faces 14 of this latter, and irrespective of the angular orientation of the cover 4 with respect to the actuator 1, said ramp causes a helical movement of rotation of the cover 4 with respect to the actuator as a result of frictional contact until the planes of symmetry of these latter come into coincident relation. The cover 4 then continues to move downwards axially with respect to the actuator and the sides 15 of the lug guide the straight portion 12 of the ramp 11-12.

When the top portion of the actuator 1 comes up against the top bearing members 10, the actuator is accordingly located in the desired position in which the discharge nozzle 8 is located opposite to the opening 9 of the protective cover.

In order to avoid a position of equilibrium which would prevent orientation of the cover 4 whenever the point of the lug 13 comes into contact with the central portion of the section 12 of the ramp 11-12, said central portion is provided with an extension in the form of a point 16 which causes said ramp to cooperate with either of the two bevelled faces 14 of the lug 13.

In its final position (shown in FIG. 1), the cover 4 is maintained on the container 3 by resilient engagement of an internal bead 17 of the cover 4 within a peripheral lateral groove 18 of the container 3.

In the second embodiment of the invention which is illustrated in FIGS. 4 to 9, the same reference numerals have again been employed to designate the elements which are identical with or equivalent to those shown in FIGS. 1 to 3.

In this embodiment, the aerosol pack (shown in FIGS. 4 and 6) comprises a container 3 fitted with a female valve 19 in which is inserted the hollow valve stem 20 of a valve actuator 1 which is fitted with a spray-discharge nozzle 8 in the conventional manner. Said nozzle 8 is oriented in oppositely-facing relation to a slit-shaped opening 21 of a sleeve 7 forming the manually operable movable portion 6 of a protective cover 4, the internal bead 17 of which is resiliently engaged within the groove 18 of the container 3.

The protective cover 4 is provided with a cut-out recess 22 located opposite to the opening 21 of the sleeve 7.

The movable portion 6 has a hollow depression 23 which facilitates application of the user's finger. Said movable portion is joined to the protective cover 4 by means of breakable ties 24 which constitute a conventional guarantee prior to initial use and by means of articulation arms 25.

The sleeve 7 is provided internally with a semi-circular wall 26 which is coaxial with the sleeve and the free edge 27 of which is cut in the shape of a double symmetrical helical ramp having a slope of at least 45°.

Figure 5:
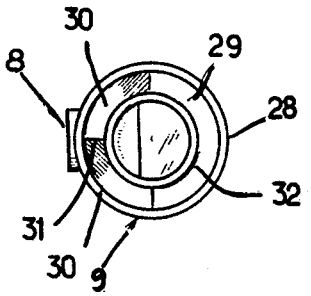
FIG. 5 is a top view of the actuator shown in FIG. 4.

The semi-cylindrical wall 28 of the actuator 1 which is located opposite to the discharge nozzle 8 (as shown in FIG. 5) is separated from the body of said nozzle 8 by means of a semi-annular recess 29 extended by a semi-annular wedge-shaped lug 30 in which the arris 31 at the top of the actuator 1 is perpendicular to the actuator axis which is common to the valve 19.

Figure 4:
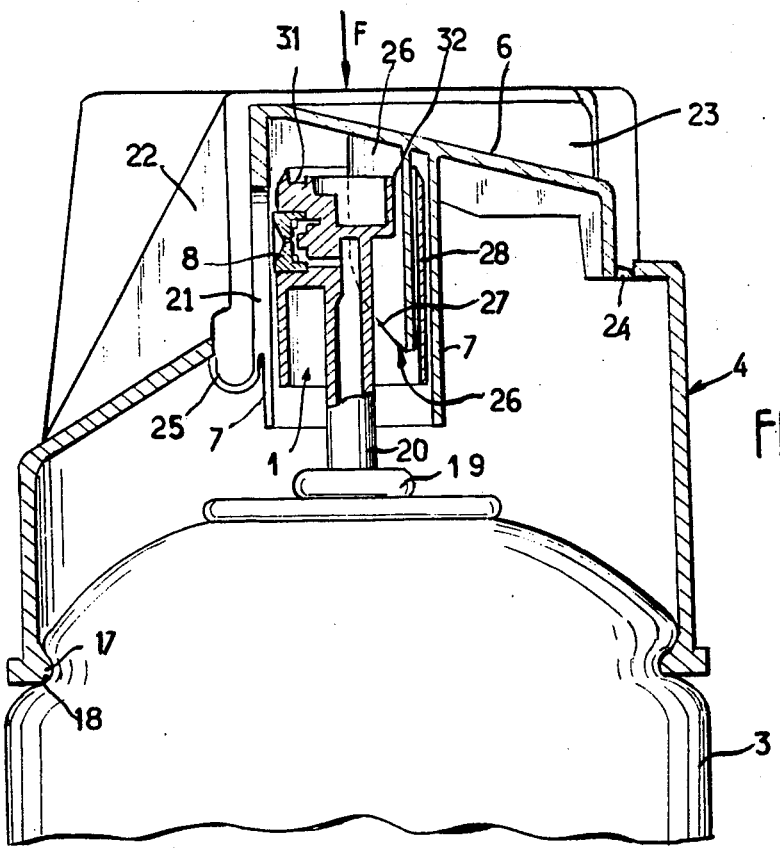
FIG. 4 is a fragmentary part-sectional view in elevation showing an aerosol container fitted with a protective cover and with a self-orienting valve actuator in accordance with a second embodiment of the invention.

When the actuator 1 is correctly oriented with respect to the cover 4 (as shown in FIG. 4), the semi-cylindrical wall 28 of the actuator slides freely between the sleeve 7 and the semi-circular wall 26 which in turn slides freely between the semi-cylindrical wall 28 and the internal wall 32 of the actuator body.

When the actuator 1 is not correctly oriented with respect to the cover 4 (FIG. 7), the helical edge 27 of the internal wall 28 of the sleeve 7 is brought to bear against the wedge-shaped lug 30 and a thrust applied on the cover in the direction of the arrow F causes the actuator 1 to carry out a movement of rotation until the wall 28 of the sleeve 7 penetrates entirely within the hollowed-out portion 29 of the valve actuator. The actuator 1 is then oriented within the protective cover 4 as shown in FIG. 8. Throughout the movement of rotation, the actuator 1 is maintained axially within the cover 4 by the sleeve 7. Said actuator is thus not liable to cause any damage either to the cover 4 or to the valve 19 at the time of positioning of the unit consisting of actuator 1 and cover 4 on the container 3.

In order to ensure that a unit of this type can be mounted both on a container of the male valve type and on a container of the female valve type, it is preferable at the outset to place the spray-discharge valve actuator 1 within the protective cover 4 (which can be carried out in continuous operation on a conveyor belt, for example), then to mount the non-oriented spray-dispenser and cover assembly on the container which has previously been filled with propellant with minimum loss since no hindrance is caused by excessive bulk of the actuator within the filling head. When the discharge valve actuator 1 is placed within the cover 4, said actuator is maintained therein by friction during subsequent handling operations.

Should it be desired, however, to mount a unit of this type on a container 3 which has previously been fitted with the actuator 1 (as shown in FIG. 6), the cover 4 is simply brought into position on the container 3 which has been filled without any need to take special precautions. The cover 4 is then pushed downwards in the direction of the arrow F and snap-fastened onto the container 3, thus automatically and simultaneously orienting the actuator 1, the stem 20 of which is pivotally displaced within the valve 19.

The third embodiment of the invention which is partially illustrated in FIGS. 10 to 13 differs from those described in the foregoing with reference to FIGS. 1 to 3 and 4 to 9 only in the particular structures of the cover 4 and of the actuator 1. In order to designate elements which are either identical with or equivalent to those shown in FIGS. 1 to 9, the same references have been employed as in said FIGS. 1 to 9.

In this embodiment, the movable portion 6 of the cover 4 is adapted to carry in addition to the sleeve 7 a wall 26 which is internally coaxial with the sleeve 7. The ramp 27-33 is carried by the wall 26, the bottom edge of which constitutes the helical portion in the form of two symmetrical helical ramps 27. The straight section 33 of the ramp 27-33 which is designed in the form of an elongated slot is disposed laterally in the wall 26 and forms an extension of the helical portion 27 without any break in continuity.

The sleeve 7 extends beyond the bottom edge of the wall 26 and ensures axial guiding of the cover 4 at the time of orientation of this latter with respect to the actuator 1.

The actuator 1 is provided with a lug 34 having the shape of an arrow, said lug being located above the discharge nozzle 8 and upwardly oriented.

Figure 10:
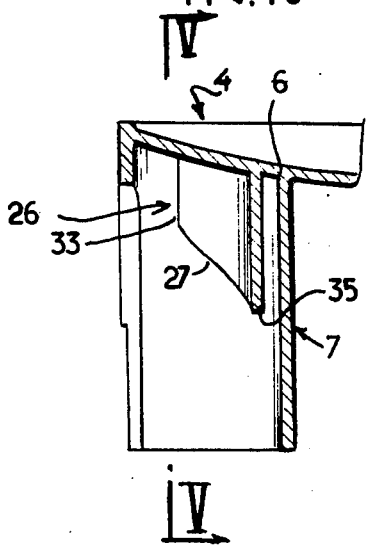
FIG. 10 is a fragmentary sectional front view of a protective cover in accordance with a third embodiment of the invention.
Figure 11:
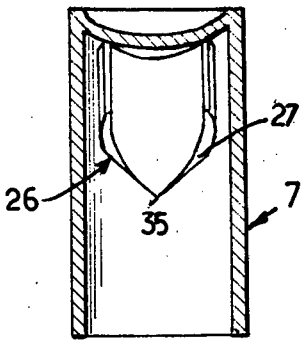
FIG. 11 is a left-hand sectional view taken along line I—I of the protective cover shown in FIG. 10.
Figure 12:
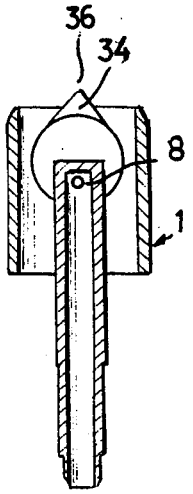
FIG. 12 is a sectional front view of a valve actuator which cooperates with the protective cover shown in FIGS. 10 and 11.
Figure 13:
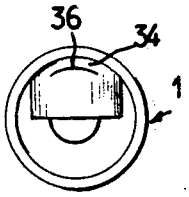
FIG. 13 is a top view of the valve actuator shown in FIG. 12.

Mounting of the protective cover shown in FIGS. 10 and 11 is carried out in the same manner as in the preceding embodiments, subject to the condition that, at the time of orientation of the cover 4 with respect to the actuator 1, said cover is guided axially by the sleeve 7 into which it has already penetrated.

Since the extremity 35 of the helical portion 27 has a pointed shape as is the case with the extremity 36 of the lug 34, the cover 4 can only move with respect to the actuator down to the desired position irrespective of its initial position.

As can readily be understood, the invention is not limited in any sense to the embodiments described in the foregoing with reference to the accompanying drawings but, depending on the applications which are contemplated, permits of many alternative forms within the capacity of anyone versed in the art without thereby departing either from the scope or the spirit of the invention.

In particular, the dispensing unit in accordance with the invention finds an application not only in the field of aerosol containers but also in the case of all containers which are designed to be equipped with an actuator and a protective cover including, for example, containers of the type provided with a spray-discharge pump.

We claim:

1. A dispensing unit for an aerosol container, comprising:

an actuator adapted to be connected to a valve on the container to actuate said valve, said actuator comprising a lateral spray-discharge nozzle and passage means for delivering fluid from the valve to said nozzle;

a protective cover having an upper section, and a depending skirt, said cover being adapted to fit coaxially over said actuator and be secured by said skirt on the container in a circumferentially oriented position relative to the actuator in a manner permitting manual operation of said actuator, said protective cover having a spray-discharge opening in said upper section which opening is located in front of said nozzle when said cover is in said oriented position with respect to said actuator;

orienting means to orientate said cover with respect to said actuator when fitting said cover on said container comprising means within said cover providing two helical ramps and a cooperating lug on said actuator circumferentially aligned with said nozzle;

a slot formed through said cover and extending in an axial direction from said opening to said ramps for sliding movement with said lug when the cover is in the oriented position, said slot being aligned with said opening and said nozzle when in the oriented position such that the spray-discharge from said nozzle passes through said slot and then through said opening, and an axial sleeve in said cover having at least a semi-cylindrical shape and having sliding engagement with said actuator during orientation of said cover, said ramps being formed by a bottom edge of said sleeve and extending symmetrically helically upwardly to said slot with an angle of slope of at least 45° with respect to the axis of the cover.

2. A dispensing unit according to claim 1, wherein said sleeve is integral with a portion of the cover which is movable for operating the valve.

3. A dispensing unit according to claim 2, wherein said lug is a wedge-shaped lug formed under said nozzle.

4. A dispensing unit for an aerosol container, comprising:

an actuator adapted to be connected to a valve on the container to actuate said valve, said actuator comprising a lateral spray-discharge nozzle and passage means for delivering fluid from the valve to said nozzle;

a protective cover having an upper section and a depending skirt, said cover being adapted to fit coaxially over said actuator and be secured by said skirt on the container in a circumferentially oriented position relative to the actuator in a manner permitting manual operation of said actuator, said protective cover having a spray-discharge opening in said upper section which opening is located in front of said nozzle when said cover is in said oriented position with respect to said actuator;

orientating means to orientate said cover with respect to said actuator when fitting said cover on said container comprising means within said cover providing two helical ramps and a cooperating lug on said actuator in the vicinity of said nozzle;

a slot formed through said cover and extending in an axial direction from said opening to said ramps for sliding enagement with said lug when the cover is in the oriented position, and an at least semi-cylindrical wall of said cover delimitating said slot and said ramps, and in sliding engagement with said actuator during orientation of said cover, and wherein said actuator comprises a semi-annular recess for receiving said semi-cylindrical wall in the orientated position and said lug is a semi-annular lug located above the nozzle and having a wedge-shape protruding from a top face of the actuator.

5. A dispensing unit according to claim 4, wherein said wall is integral with a portion of the cover which is movable for manually pressing on said actuator to operate the valve.

6. A dispensing unit according to claim 4, wherein said cover further comprises a cylindrical sleeve extending externally of the actuator coaxially with said wall and extending axially beyond the bottom edge of said wall.

7. A dispensing unit according to claim 4, wherein said ramps extend symmetrically helically upwardly to said slot with an angle of slope of at least 45° with respect to the axis of the cover.

* * * * *